US007083027B2

(12) United States Patent
Siikonen et al.

(10) Patent No.: US 7,083,027 B2
(45) Date of Patent: Aug. 1, 2006

(54) ELEVATOR GROUP CONTROL METHOD USING DESTINATION FLOOR CALL INPUT

(75) Inventors: Marja-Liisa Siikonen, Helsinki (FI); Jari Ylinen, Hyvinkää (FI)

(73) Assignee: KONE Corporation, Helsinki (FI)

( * ) Notice: Subject to any disclaimer, the term of this patent is extended or adjusted under 35 U.S.C. 154(b) by 0 days.

(21) Appl. No.: 11/073,503

(22) Filed: Mar. 8, 2005

(65) Prior Publication Data

US 2005/0217946 A1 Oct. 6, 2005

Related U.S. Application Data

(63) Continuation of application No. PCT/FI03/00665, filed on Dec. 9, 2003.

(30) Foreign Application Priority Data

Oct. 1, 2002 (FI) ..... 20021746

(51) Int. Cl.
*B66B 1/20* (2006.01)

(52) U.S. Cl. ..... 187/383; 187/391

(58) Field of Classification Search ..... 187/247, 187/248, 380–389, 391
See application file for complete search history.

(56) References Cited

U.S. PATENT DOCUMENTS

| | | | | | |
|---|---|---|---|---|---|
| 4,363,381 | A | * | 12/1982 | Bittar | 187/387 |
| 4,838,384 | A | * | 6/1989 | Thangavelu | 187/385 |
| 5,024,295 | A | * | 6/1991 | Thangavelu | 187/382 |
| 5,252,789 | A | * | 10/1993 | Sirag et al. | 187/385 |
| 5,305,198 | A | | 4/1994 | Schroder et al. | |
| 5,511,635 | A | * | 4/1996 | Kameli | 187/392 |
| 5,780,789 | A | | 7/1998 | Tsuji | |

FOREIGN PATENT DOCUMENTS

| | | | |
|---|---|---|---|
| EP | 0 356 731 | A | 3/1990 |
| EP | 0452225 | A2 * | 10/1991 |
| FI | 972 937 | A | 1/1999 |

* cited by examiner

*Primary Examiner*—Jonathan Salata
(74) *Attorney, Agent, or Firm*—Birch, Stewart, Kolasch & Birch, LLP

(57) ABSTRACT

A method controls the elevators in an elevator group when destination floor call input is used and the traffic within the elevator group is to be optimized. According to the concept of the method, based on traffic intensity, a cost function is optimized by changing the number of cost criteria from one to several and back and weighting the criteria in different ways in the aforesaid cost function.

11 Claims, 3 Drawing Sheets

ELEVATOR GROUP CONTROL METHOD USING DESTINATION FLOOR CALL INPUT

This application is a Continuation of PCT Application No. PCT/FI03/00665 filed on Dec. 9, 2003, which also claims priority under Patent Application No. 20021746 filed in Finland on Oct. 1, 2002, the entire contents of both of which are hereby incorporated by reference and for which priority is claimed under 35 U.S.C. § 120.

FIELD OF THE INVENTION

The present invention relates to a method for controlling the elevators in an elevator group.

The invention relates to an elevator group control method in which destination floor call input is used.

DESCRIPTION OF RELATED ART

Prior art is described in EP patent specification 356731 (B66B 1/20), which discloses an elevator group control system using immediate allocation of destination calls, wherein, immediately after the input of a call, the operating costs corresponding to the waiting times of passengers are computed merely for the input floor and the destination floor of the new call. After this, a comparison of these costs is performed, whereupon the call is assigned to the elevator with the smallest operating costs.

Prior art is also described in FI application document 972937 (B66B 1/20), which discloses an elevator group control system in which the control of the elevators is optimized on the basis of the traffic situation, i.e. the currently prevailing type and intensity of traffic. The prevailing traffic situation is identified and the elevator group is controlled on the basis of a predetermined so-called expert rule corresponding to the aforesaid traffic situation.

A problem with solutions according to the present state of the art using normal control and zoning for controlling the elevators in an elevator group is that, in quiet traffic conditions, congestion occurs in the elevator lobby when optimization is exclusively applied to the transportation capacity or the traveling times. To provide room for the passengers in the elevator lobby, it would be necessary to build a larger elevator lobby, which again would be too expensive in large buildings.

Another source of problems is the fact that, when normal control is used in elevator group control, empty elevators often pass by a floor where passengers are waiting for an elevator, which is annoying to the waiting passengers. This is a problem especially in the case of elevators with glass walls, because passengers waiting in the lobby can see the empty elevators passing by.

BRIEF SUMMARY OF THE INVENTION

The object of the present invention is to overcome the drawbacks encountered in the above-mentioned prior art.

A specific object of the invention is to reduce waiting times in an elevator lobby under quiet traffic intensity conditions of an elevator group. Congestion of the elevator lobby is thus avoided and the need to build a larger elevator lobby for the waiting passengers is obviated. In addition, the present invention aims at reducing the lengths of waiting queues in the elevator lobby.

For example, by using the elevator group control method of the present invention, the queues during quiet traffic will be of the same order as when a conventional, normal and continuous allocation method is used, while in an intensive up-peak traffic situation the transportation capacity of the elevator group will exceed the capacity of an elevator group control system using a conventional, normal and continuous allocation method by about 70–100%.

As compared with prior art, the method of the invention provides significant advantages.

The most important advantage achieved by the present invention is that the method significantly improves passenger service and reduces passenger waiting times in the entrance lobby. In particular, the method of the invention reduces passenger waiting times in the entrance lobby of the elevator group when the traffic intensity for the elevator group is low. Therefore, the queues of passengers waiting for elevators in the elevator lobby are significantly shortened during quiet traffic conditions.

In busy traffic conditions, the present invention affords the advantage of increasing the passenger transportation capacity of the elevator group.

The present invention concerns a method for controlling the elevators in an elevator group when destination floor call input is used and the traffic within the elevator group is to be optimized. According to the most preferred embodiment of the present invention, based on traffic intensity and traffic type, a cost function is optimized by changing the number of cost criteria from one to several and back and weighting the criteria in different ways in the aforesaid cost function.

According to a second embodiment of the present invention, one or more of the following cost criteria of the cost function to be optimized are optimized: waiting time of passengers, traveling time of passengers, energy consumption, car load factor, transportation capacity and time of arrival of the elevator at floors where passengers are waiting. This optimization method utilizing several optimization criteria to be optimized in the cost function is more generally called multiobjective optimization, which allows considerably better results to be achieved than when only one optimization objective is used in the cost function.

Further, according to a preferred embodiment of the invention, the cost criteria of the aforesaid cost function to be optimized are weighted by different coefficients depending on traffic intensity.

In addition, in a preferred embodiment of the invention, it is possible that, in quiet traffic conditions, only one of the cost criteria of the aforesaid cost function to be optimized is optimized, which criterion, according to a preferred embodiment of the invention, is the waiting time of passengers.

Further according to the method of the present invention, the criteria for the aforesaid quantity to be optimized are changed in the cost function in a manner such that, in low traffic intensity conditions, the waiting time is optimized, while in a more intensive traffic situation the traveling time is optimized, the latter being equal to the passenger waiting time plus the time the passenger stays onboard the elevator.

Further according to an embodiment of the invention, the cost criteria of the aforesaid quantity to be optimized are changed in the aforesaid cost function in a manner such that, when the traffic grows more intensive, the weighted cost function is optimized so that the weighting of the waiting time decreases while the weighting of the traveling time increases in the aforesaid cost function.

According to an embodiment of the invention, zoning is applied to destination floor calls issued from the lobby, and when the zone limits are taken from traffic forecasts, dynamic zoning is employed in the elevator group control during busy traffic. It is further possible that dynamic zoning with zone limits taken from traffic forecasts is used in the optimization in the elevator group control during busy traffic when equal numbers of people leave the elevator in each zone. Further according to an embodiment of the invention, one or more of the elevators in the aforesaid elevator group are used to serve two or more zones depending on the transportation need.

According to the invention, in the aforesaid elevator group, using a destination floor call input device, the one of the elevators in the elevator group allocated for each passenger is indicated by the group control system of the elevator group.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail with reference to the attached drawings, which are given by way of illustration only, and thus are not limitative of the present invention, and wherein.

DETAILED DESCRIPTION OF THE INVENTION

Figure 1:
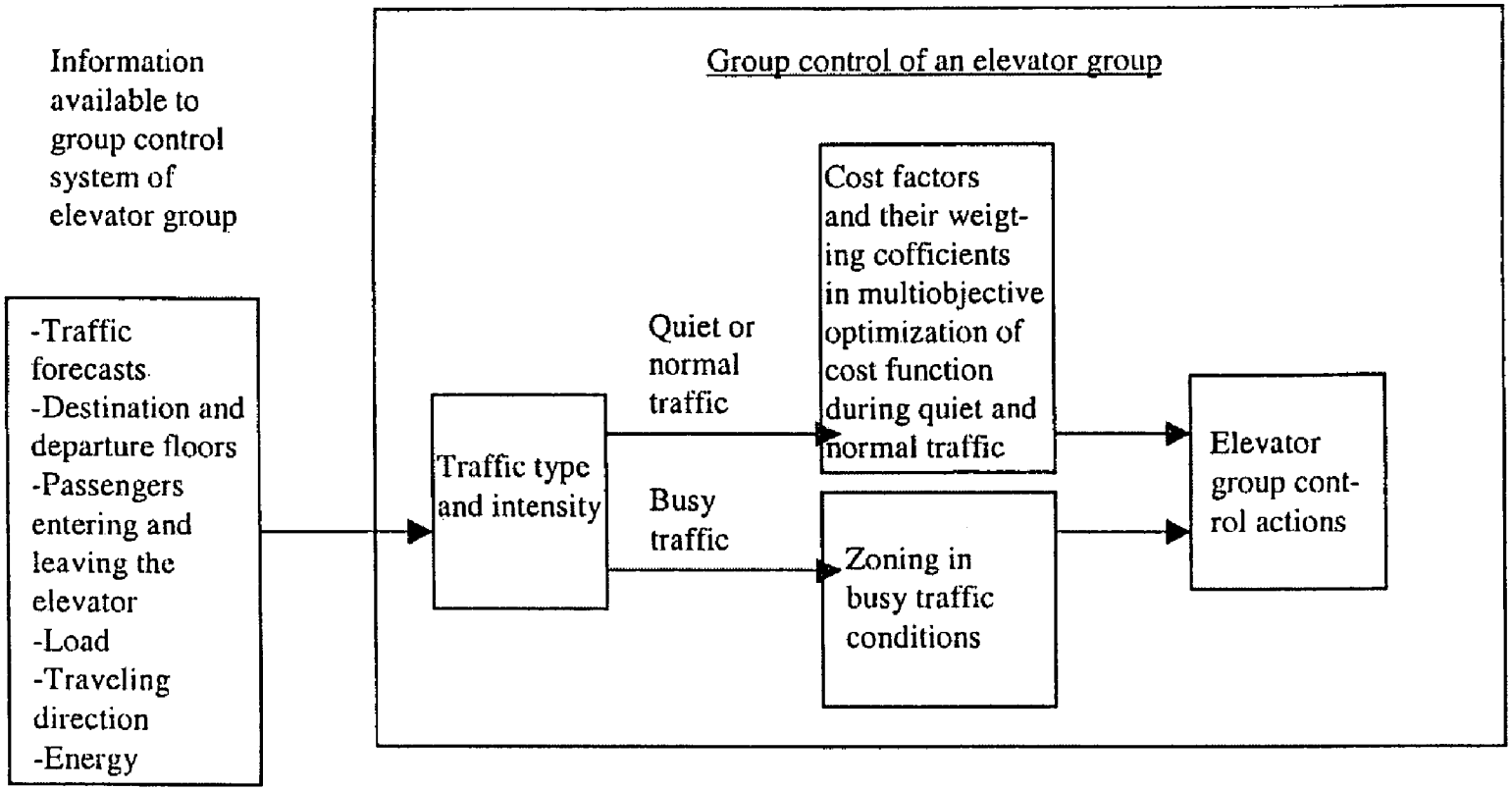
FIG. 1 represents the method of the invention in diagrammatic form, FIGS. 2A and 2B visualize two different embodiments according to the present invention when dynamic zoning is used for optimizing the passenger flow carried by an elevator group in a building.

The diagram in FIG. 1 visualizes the method of the invention, wherein the input of calls to the elevators in the elevator group is implemented using destination floor call input and the traffic within the elevator group is optimized using as a control method either multiobjective optimization or dynamic zoning, depending on the intensity and type of the traffic. The elevator group is controlled by a computer configured for this purpose.

Information for use by the group control system of the elevator group is obtained from traffic forecasts regarding the current traffic type and intensity. In forecast statistics, information is collected e.g. from car load weighing devices and/or light cells and/or destination floor call buttons, which can be utilized expressly in connection with destination control. From destination call buttons, preferably information representing traffic arrival times and passengers' floors of arrival and departure is obtained. Thus, the elevator group control system has information available regarding the passengers' floors of destination and departure. Likewise, the car load weighing device and light cells can be used to measure other values descriptive of the traffic, such as movements of people. In this case, the elevator group control system has information available regarding passengers entering the elevator and passengers leaving the elevator as well as the load of the elevators and the traveling directions of the passengers on the elevators. In addition, the energy consumed by the elevators can be measured. The aforesaid traffic type of the elevator group has four categories: low traffic, normal traffic, busy traffic and intensive traffic.

On the basis of the above-described information, the currently prevailing traffic type and traffic intensity are determined for the elevator group control system. When multiobjective optimization is utilized in the control, the cost factors to be used in the cost function in each case as well as suitable weightings for them can be selected using the aforesaid traffic type and intensity data.

As an inventive step in the method according to the present invention, the cost function is optimized according to traffic intensity by changing the number of cost functions from one to several and back and weighting them in different ways in the aforesaid cost function.

In the method of the invention, the cost factors of the cost function to be optimized include one or more of the following: waiting time of passengers, traveling time of passengers, energy consumption, car load factor, transportation capacity, elevator arrival time at floors where passengers are waiting.

Likewise on the basis of information available to the elevator group control system, the traffic type is determined. When it is established that the traffic type prevailing in the elevator group is intensive traffic, dynamic zoning is adopted as an optimization method in the optimization process. When a low or normal traffic type prevails, the aforesaid multiobjective optimization method is used. After identifying the traffic type and making a decision regarding the control, the elevator group control system carries out elevator group control actions to control the elevators in a manner as optimal as possible.

When dynamic zoning is adopted in the group control of the elevator group in a busy traffic situation, the zone limits are obtained from traffic forecasts. Zoning is implemented for destination floor calls issued from the elevator lobby. Likewise, zoning can be activated when equal numbers of passengers leave the elevator in each zone.

According to an embodiment of the invention, dynamic zoning is used for optimizing the passenger flow of the elevator group in the group control of the elevator group in a busy traffic situation so that passengers entering from the entrance floor are assigned to zones comprising adaptive zone limits when equal numbers of passengers leave the elevator in each zone.

According to another embodiment, dynamic zoning is used for optimizing the passenger flow of the elevator group in the group control of the elevator group in a busy traffic situation so that passengers entering from congested floors are assigned to zones comprising adaptive zone limits when equal numbers of passengers leave the elevator in each zone.

One of the basic ideas in the method described above is that in low traffic conditions the waiting times are optimized and in more intensive, i.e. normal traffic conditions passengers' traveling times are optimized, while in busy traffic conditions dynamic zoning is used. When the elevator group is controlled according to this method, the queues during low traffic will be of the same order as when normal allocation methods are used, while in a busy traffic situation the transportation capacity of the elevator group is increased by about 70% over the group control of an elevator group using normal allocation methods.

Figure 2B:
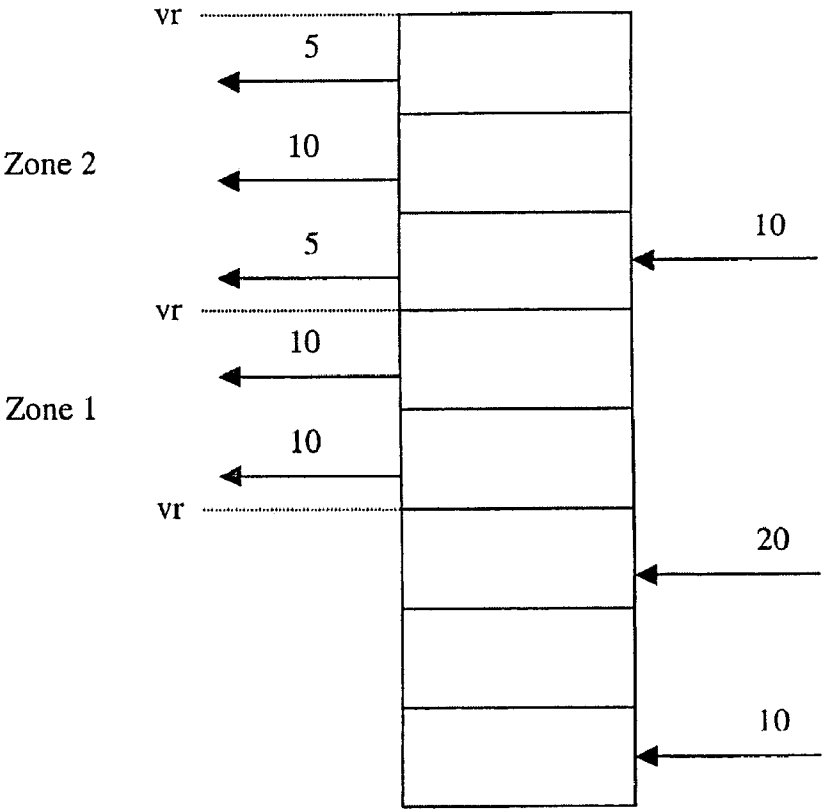
Figure 2A:
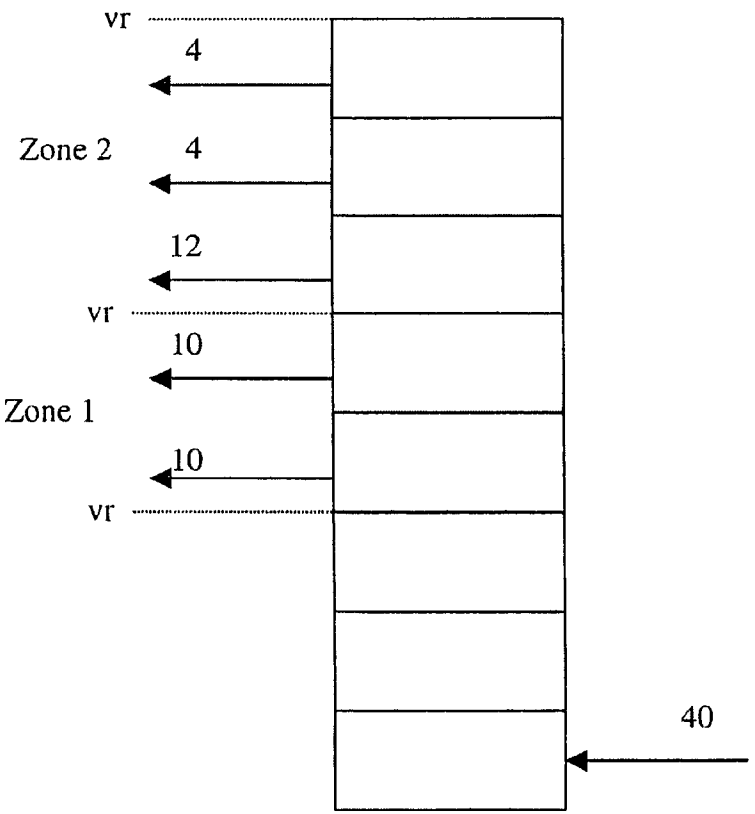

FIG. 2A visualizes an embodiment of the invention when dynamic zoning is used for optimizing the passenger flow handled by an elevator group in a building. When zoning is implemented for destination floor calls issued from the lobby, i.e. from the entrance floor, and when the zone limits are taken from traffic forecasts, dynamic zoning is used in the elevator group control for optimizing the passenger flow in the elevator group in a busy traffic situation when the traffic intensity of the passenger flow exceeds a given preset limit value.

In the situation illustrated in FIG. 2A, dynamic zoning is used in the elevator group control in the building for optimizing the passenger flow in the elevator group in a busy traffic situation so that passengers entering from the entrance floor are assigned to zones comprising adaptive zone limits vr when equal numbers of passengers leave the elevator in each zone. In the example presented in the figure, 40 passengers enter the elevator group from the entrance floor and their destination floors are distributed equally between two different zones (zone 1 & zone 2). In other words, equal numbers of passengers leave the elevator in each zone (zone 1 & zone 2), although the aforesaid zones (zone 1 & zone 2) comprise different numbers of floors, while the number of passengers leaving the elevator at these floors varies according to the traffic situation determined by the destination floor calls.

The zone limits vr of the aforesaid zones (zone 1 & zone 2) are distributed adaptively so that the zone limits vr vary in the building, allowing floor-specific optimization of the passenger traffic in the elevator group of the building. This enables the elevators of the elevator group to serve the most congested entrance floors in an optimal way in busy traffic conditions. These aforesaid zone limits vr are obtained from the traffic forecasts.

In the situation illustrated in FIG. 2B, in which passengers enter the elevator group from certain congested floors in the building, dynamic zoning is used in the elevator group control for optimizing the passenger flow in the elevator group in a busy traffic situation so that the passengers entering from said certain congested floors are assigned to zones comprising adaptive zone limits vr when equal numbers of passengers leave the elevator in each zone.

This figure visualizes a traffic situation where, in a zoned building, there are three entrance floors with heaviest traffic, with ten (10) passengers on two of said floors and (20) passengers on one of them waiting to enter the elevator group. The passengers of the elevator group are distributed equally between two zones (zone 1 & zone 2) formed from the passengers' destination floors so that equal numbers (20) of passengers leave the elevator in each zone (zone 1 & zone 2).

In the situations presented in the aforesaid FIGS. 2A and 2B, one or more of the elevators in the elevator group are used to serve two or more zones, depending on the transportation need.

Figure 3:
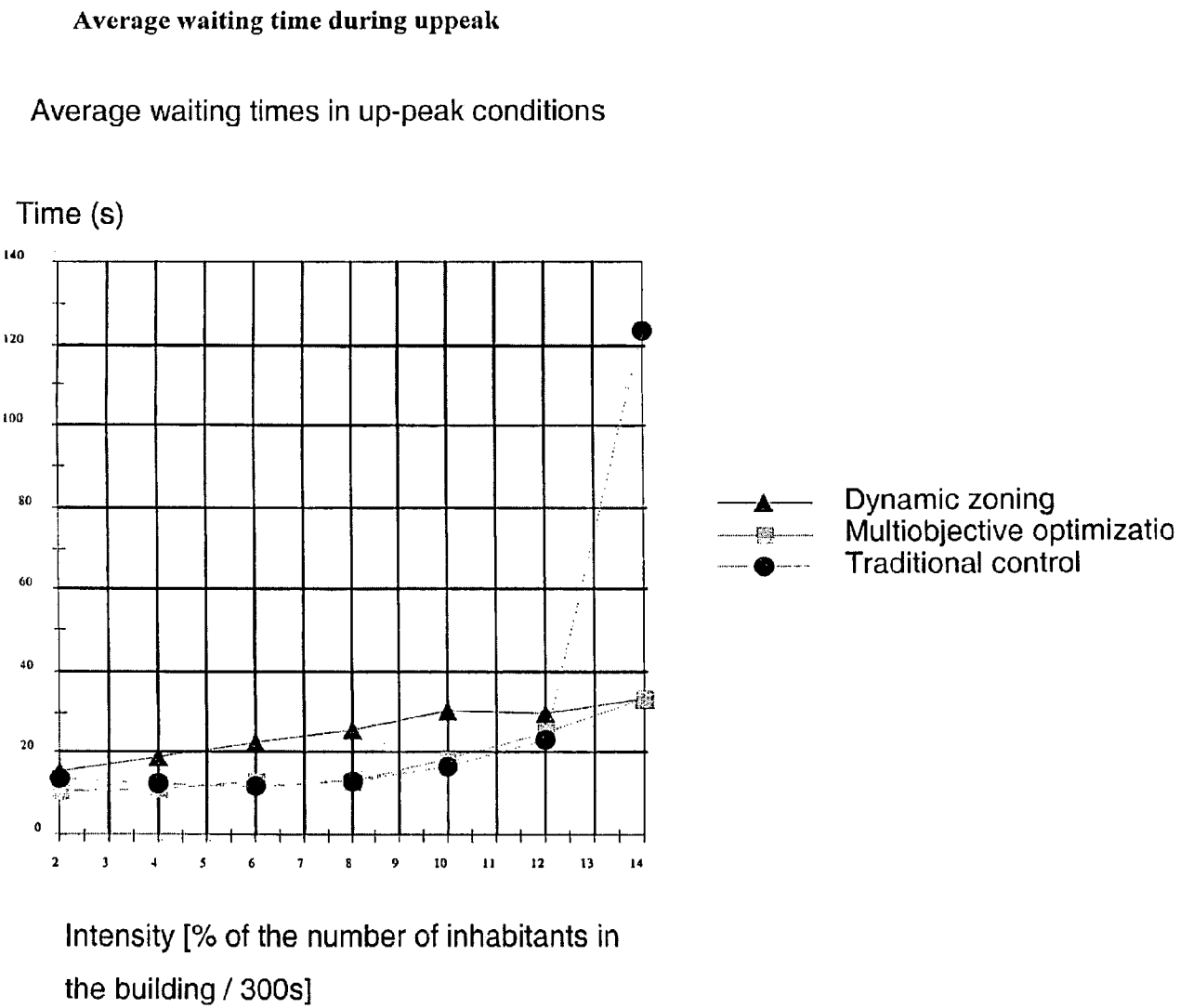
FIG. 3 shows average waiting times in an up-peak traffic situation in an elevator group in the cases of dynamic zoning, multiobjective optimization and destination-multiobjective optimization.

FIG. 3 shows the average waiting times in up-peak traffic conditions in the elevator group as a function of traffic intensity when the group control method used to control the elevator group is dynamic zoning or multiobjective optimization or traditional control based on up/down call buttons. The results presented in the figure have been obtained by utilizing an elevator traffic simulator in a building.

From this figure we can see that, as elevator group control methods, both dynamic zoning and multiobjective optimization are of equal efficiency in busy traffic conditions from a certain traffic intensity limit value upwards. At a certain traffic intensity value, equal waiting times are achieved by both elevator group control methods.

From FIG. 3 it can also be seen that, when the traffic intensity in the elevator group is below the above-mentioned certain traffic intensity value, the waiting times of the passengers of the elevator group differ from each other when dynamic zoning or multiobjective optimization is used as the group control method of the elevator group. Multiobjective optimization here yields considerably shorter passenger waiting times as compared with mere dynamic zoning. In other words, at low traffic intensity values, when multiobjective optimization is used as the group control method of the elevator group, considerably shorter passenger waiting times are achieved as compared with dynamic zoning. Comparing traditional control based on up/down buttons to multiobjective optimization at low traffic intensity values, the waiting times are equally short. In traditional control, the waiting times start increasing steeply when the transportation capacity limit of the control system is exceeded. Via multiobjective optimization, in low traffic conditions short waiting times are obtained, but also a much greater transportation capacity is achieved than with traditional control. Thus, based on the above comparison, multiobjective optimization allows shorter waiting times to be achieved at all-traffic intensity values, thereby also significantly shortening the queues of passengers in elevator lobbies.

In the foregoing, the invention has been described by way of example with reference to the attached drawings while different embodiments of the invention are possible in the scope of the inventive concept defined in the claims.

The invention claimed is:

1. Method for controlling the elevators in an elevator group when destination floor call input is used and the traffic within the elevator group is to be optimized, comprising the steps of:

based on traffic intensity and traffic type, optimizing a cost function by changing the number of cost criteria and changing weighting of the criteria in the aforesaid cost function;

in the aforesaid elevator group, using a destination floor call input device, the one of the elevators in the elevator group allocated for each passenger is indicated by the group control system of the elevator group; and using dynamic zoning to optimize passenger flow in the elevator group in busy traffic situation when traffic intensity of passenger flow exceeds a given preset limit value.

2. The method according to claim 1, wherein one or more of the following cost criteria of the aforesaid cost function to be optimized are optimized: waiting time of passengers, traveling time of passengers, energy consumption, car load factor, transportation capacity and time of arrival of the elevator at floors where passengers are waiting.

3. The method according to claim 2, wherein the cost criteria of the aforesaid cost function to be optimized are weighted by different coefficients depending on traffic intensity.

4. The method according to any one of the preceding claims, wherein in quiet traffic conditions, only one of the cost criteria of the aforesaid cost function to be optimized is optimized.

5. The method according to claim 4, wherein in quiet traffic conditions, of the cost criteria of the aforesaid cost function to be optimized, the waiting time of passengers is optimized.

6. The method according to claim 1, wherein the criteria for the aforesaid quantity to be optimized are changed in the aforesaid cost function in a manner such that, in low traffic intensity conditions, the waiting time is optimized, while in a more intensive traffic situation the traveling time is optimized.

7. The method according to claim 1, wherein the cost criteria of the aforesaid quantity to be optimized are changed in the aforesaid cost function in a manner such that, when the traffic grows more intensive, the weighted cost function is optimized so that the weighting of the waiting time decreases while the weighting of the traveling time increases in the aforesaid cost function.

8. The method according to claim 1, wherein when zoning is applied to destination floor calls issued from the lobby and when the zone limits are taken from traffic forecasts, dynamic zoning is used in the group control of the elevator group in busy entering traffic conditions.

9. The method according to claim 8, wherein dynamic zoning is used in the elevator group control for the optimization of the passenger flow in the elevator group during busy traffic so that passengers entering from the entrance floor are assigned to zones comprising adaptive zone limits when equal numbers of people leave the elevator in each zone.

10. The method according to claim 8, wherein dynamic zoning is used in the group control of the elevator group for optimizing the passenger flow in the elevator group in a busy traffic situation so that passengers entering from certain congested floors are assigned to zones comprising adaptive zone limits when equal numbers of passengers leave the elevator in each zone.

11. The method according to claim 8 or 9 or 10, wherein one or more of the elevators in the aforesaid elevator group are used to serve two or more zones according to the transportation need.

* * * * *